US008083025B2

(12) United States Patent
Murakami et al.

(10) Patent No.: US 8,083,025 B2
(45) Date of Patent: Dec. 27, 2011

(54) SILENCER PROVIDED ON EXHAUST PIPE OF VEHICLE ENGINE

(75) Inventors: Fumiaki Murakami, Wako (JP); Yoshihiko Eguchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/840,297

(22) Filed: Jul. 21, 2010

(65) Prior Publication Data

US 2011/0024228 A1 Feb. 3, 2011

(30) Foreign Application Priority Data

Jul. 31, 2009 (JP) ..... 2009-179381

(51) Int. Cl.

| | |
|---|---|
| ***F01N 1/02*** | (2006.01) |
| ***F01N 1/04*** | (2006.01) |
| ***F01N 1/08*** | (2006.01) |
| ***F01N 1/10*** | (2006.01) |
| *F01N 1/00* | (2006.01) |

(52) U.S. Cl. ..... 181/249; 181/252; 181/267

(58) Field of Classification Search ..... 181/249, 181/248, 247, 252, 267, 251

See application file for complete search history.

(56) References Cited

U.S. PATENT DOCUMENTS

| | | | | | |
|---|---|---|---|---|---|
| 712,791 | A | * | 11/1902 | Hedstrom | 181/265 |
| 858,455 | A | * | 7/1907 | Hedstrom | 181/236 |
| 927,246 | A | * | 7/1909 | Jackson | 181/267 |
| 1,076,494 | A | * | 10/1913 | Galaine | 181/253 |
| 1,087,468 | A | * | 2/1914 | Steinmetz | 181/269 |
| 1,318,890 | A | * | 10/1919 | MacKenzie | 181/265 |
| 1,554,351 | A | * | 9/1925 | Jack | 181/267 |
| 1,861,775 | A | * | 6/1932 | Aseltine | 181/267 |
| 1,876,861 | A | * | 9/1932 | Compo | 181/264 |
| 1,881,051 | A | * | 10/1932 | Haas | 181/264 |
| 1,968,312 | A | * | 7/1934 | Rensink | 96/383 |
| 1,995,071 | A | * | 3/1935 | Haas et al. | 181/256 |
| 2,039,800 | A | * | 5/1936 | Jack William A | 181/252 |
| 2,041,767 | A | * | 5/1936 | Jack | 181/248 |
| 2,150,811 | A | * | 3/1939 | Starkweather et al. | 181/266 |
| 2,402,078 | A | * | 6/1946 | Peters | 181/266 |
| 2,527,052 | A | * | 10/1950 | Beck et al. | 181/265 |
| 2,600,262 | A | * | 6/1952 | Powers Walter H | 96/385 |
| 2,640,557 | A | * | 6/1953 | Gaffney | 181/256 |
| 3,415,336 | A | * | 12/1968 | Arthur et al. | 181/252 |
| 3,685,616 | A | * | 8/1972 | Malkiewicz | 181/266 |
| 3,710,891 | A | * | 1/1973 | Flugger | 181/256 |
| 3,901,350 | A | * | 8/1975 | Loffelhardt | 181/256 |
| 4,228,868 | A | * | 10/1980 | Raczuk | 181/247 |
| 4,550,799 | A | * | 11/1985 | Flugger | 181/244 |

(Continued)

FOREIGN PATENT DOCUMENTS

JP 2008-138608 6/2008

*Primary Examiner* — Edgardo San Martin

(74) *Attorney, Agent, or Firm* — Ditthavong Mori & Steiner, P.C.

(57) ABSTRACT

A silencer includes an inner cylinder that is connected to an exhaust pipe and a partition cylinder that is accommodated in a housing and that sections an expansion chamber in the housing. A group of partition-cylinder small holes is formed in the partition cylinder, and a group of inner-cylinder small holes is formed in the inner cylinder. The group of partition-cylinder small holes and the group of inner-cylinder small holes do not overlap each other in an axial direction, and are separated from each other by a predetermined distance in the axial direction.

7 Claims, 7 Drawing Sheets

U.S. PATENT DOCUMENTS 4,779,703 A * 10/1988 Takiguchi et al. ..... 181/228
5,661,272 A * 8/1997 Iannetti ..... 181/256
5,892,186 A * 4/1999 Flugger ..... 181/252
6,336,471 B1 * 1/2002 Feuling ..... 138/39
6,857,502 B2 * 2/2005 Naito ..... 181/252
7,380,397 B2 * 6/2008 Chang ..... 60/324
7,552,797 B2 * 6/2009 Luttig ..... 181/250
2008/0017444 A1 * 1/2008 Dowdy ..... 181/251

* cited by examiner

SILENCER PROVIDED ON EXHAUST PIPE OF VEHICLE ENGINE

CROSS REFERENCES TO RELATED APPLICATIONS

The present application claims priority under 35 U.S.C. §119 to Japanese Patent Application No. 2009-179381, filed Jul. 31, 2009, entitled "SILENCER PROVIDED ON EXHAUST PIPE OF VEHICLE ENGINE." The contents of this application are incorporated herein by reference in their entirety.

BACKGROUND OF THE INVENTION

1. Field of the Invention

The present invention relates to a silencer provided on an exhaust pipe of a vehicle engine.

2. Description of the Related Art Japanese Unexamined Patent Application Publication No. 2008-138608 discloses an example of a silencer provided on an exhaust pipe of a vehicle engine. This silencer includes an inner cylinder 10 disposed at an intermediate position of the exhaust pipe 3; a housing 12 that accommodates the inner cylinder 10 and defines an expansion chamber 11 between the inner cylinder 10 and the housing 12; and a partition cylinder 17 accommodated in the housing 12, the partition cylinder 17 sectioning the expansion chamber 11 in the housing 12 into an inner expansion-chamber section 11*a* at an inner region in a radial direction and an outer expansion-chamber section 11*b* at an outer region in the radial direction, the outer expansion-chamber section 11*b* being filled with an acoustic material 23, the partition cylinder 17 having a group of small holes 22 through which the inner expansion-chamber section 11*a* and the outer expansion-chamber section 11*b* communicate with each other. The inner cylinder 10 has a group of small holes 21 through which the inside of the inner cylinder 10 communicates with the inner expansion-chamber section 11*a*. The exhaust sound that travels through the exhaust pipe 3 spreads into the inner expansion-chamber section 11*a* through the small holes 21 in the inner cylinder 10, and then spreads into the outer expansion-chamber section 11*b* through the small holes 22 in the partition cylinder 17, so that the sound pressure of the exhaust sound is attenuated in the outer expansion-chamber section 11*b*.

In general, acoustic materials are highly effective in attenuating the sound pressure of a high-frequency component (500 Hz or more) of the exhaust sound. However, acoustic materials cannot effectively attenuate the sound pressure of a low-frequency component (100 Hz or less) of the exhaust sound. Therefore, the silencer disclosed in Japanese Unexamined Patent Application Publication No. 2008-138608 has a disadvantage that although the sound pressure of the high-frequency component can be effectively attenuated, the sound pressure of the low-frequency component cannot be sufficiently attenuated.

In general, the following measures are effective in attenuating the sound pressure of the low-frequency component of the exhaust sound:

(1) to reduce the diameter of the exhaust pipe, that is, to narrow the exhaust passage;

(2) to increase the length of the exhaust pipe, that is, to increase the length of the exhaust passage; and (3) to increase the capacity of the expansion chamber.

However, measure (1) has a problem that a back pressure, which is a pressure that obstructs the discharge of the exhaust gas, will be increased and the engine output will be reduced.

In addition, measure (2) has a problem that there may be a case where the length of the exhaust pipe cannot be increased owing to the restriction on the total vehicle length or the need to avoid interference with other components under the vehicle floor. Similarly, measure (3) has a problem that there may be a case where the capacity of the expansion chamber cannot be increased owing to the need to avoid interference with other components under the vehicle floor. Thus, each of measures (1) to (3) has a problem, and is difficult to carry out.

SUMMARY OF THE INVENTION

According to one aspect of the present invention, a silencer is provided on an exhaust pipe of a vehicle engine. The silencer includes an inner cylinder, a housing, and a partition cylinder. The inner cylinder is disposed at an intermediate position of the exhaust pipe. The housing accommodates the inner cylinder and defines an expansion chamber between the inner cylinder and the housing. The partition cylinder is accommodated in the housing and sections the expansion chamber into an inner expansion-chamber section at an inner region in a radial direction and an outer expansion-chamber section at an outer region in the radial direction. The outer expansion-chamber section is filled with an acoustic material. The partition cylinder has a group of partition-cylinder small holes through which the inner expansion-chamber section and the outer expansion-chamber section communicate with each other. The inner cylinder has a group of inner-cylinder small holes through which an inside of the inner cylinder communicates with the inner expansion-chamber section. The group of partition-cylinder small holes and the group of inner-cylinder small holes do not overlap each other in an axial direction and are separated from each other by a predetermined distance in the axial direction.

According to another aspect of the present invention, a silencer is provided on an exhaust pipe of a vehicle engine. The silencer includes an inner cylinder and a housing. The inner cylinder is disposed at an intermediate position of the exhaust pipe. The housing accommodates the inner cylinder and defines an expansion chamber between the inner cylinder and the housing. The expansion chamber is filled with an acoustic material. The inner cylinder has a group of inner-cylinder small holes through which an inside of the inner cylinder communicates with the expansion chamber. The inner cylinder includes an inner-side cylinder and an outer-side cylinder. The outer-side cylinder extends from a first end to a second end of the housing in an axial direction. The inner-side cylinder is supported by the outer-side cylinder at the first end of the housing in the axial direction and extends toward the second end of the housing in the axial direction such that a space is provided between the inner-side cylinder and the outer-side cylinder. An open end of the inner-side cylinder at a downstream end of the inner-side cylinder is positioned upstream of the second end of the housing and the group of inner-cylinder small holes is formed in the outer-side cylinder in an area that extends toward the first end from a position closer to the first end than the open end of the inner-side cylinder by a predetermined distance.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Embodiments of the present invention will now be described with reference to the accompanying drawings.

Silencers according to the embodiments of the present invention are provided in an exhaust system of a multicylinder engine for an automobile.

First, a first embodiment of the present invention will be described with reference to FIGS. 1 to 4.

Figure 1:
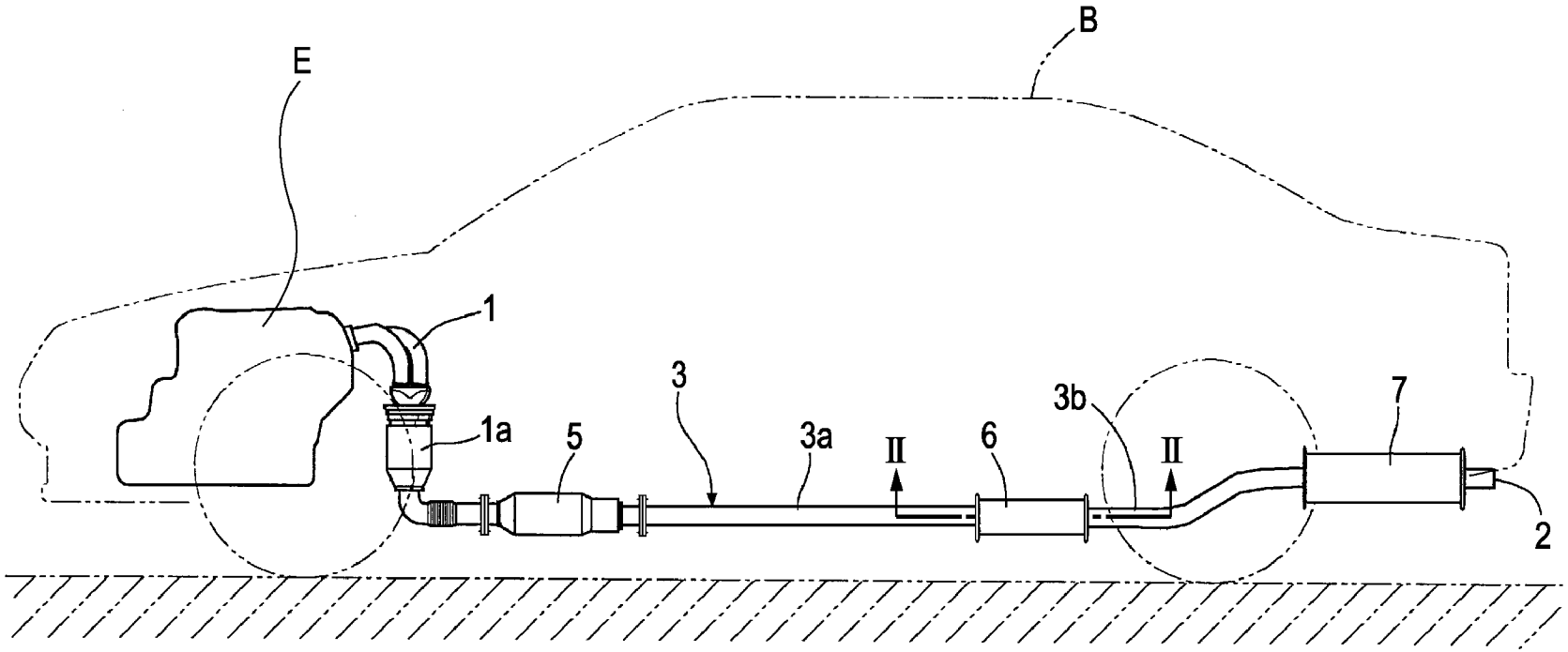
FIG. 1 is a side view of an exhaust system of a vehicle engine including a silencer according to an embodiment of the present invention (first embodiment)

Referring to FIG. 1, an exhaust manifold 1 is connected to exhaust ports of a multicylinder engine E mounted in an engine room of an automobile body B. The exhaust manifold 1 includes an exhaust collecting section 1*a*, and an exhaust pipe 3 extends from the exhaust collecting section 1*a* to an atmospheric opening 2 of a tail pipe that opens to the atmosphere. The exhaust pipe 3 extends under the floor of the automobile body B along a longitudinal direction.

A catalytic converter 5, a pre-muffler (auxiliary silencer) 6, and a main muffler (main silencer) 7 are attached to the exhaust pipe 3 such that the catalytic converter 5, the pre-muffler 6, and the main muffler 7 are arranged in that order from an upstream position, that is, from the engine E, with intervals therebetween.

The pre-muffler 6 is a silencer according to an embodiment of the present invention. The pre-muffler 6 will now be described in detail.

Figure 2:
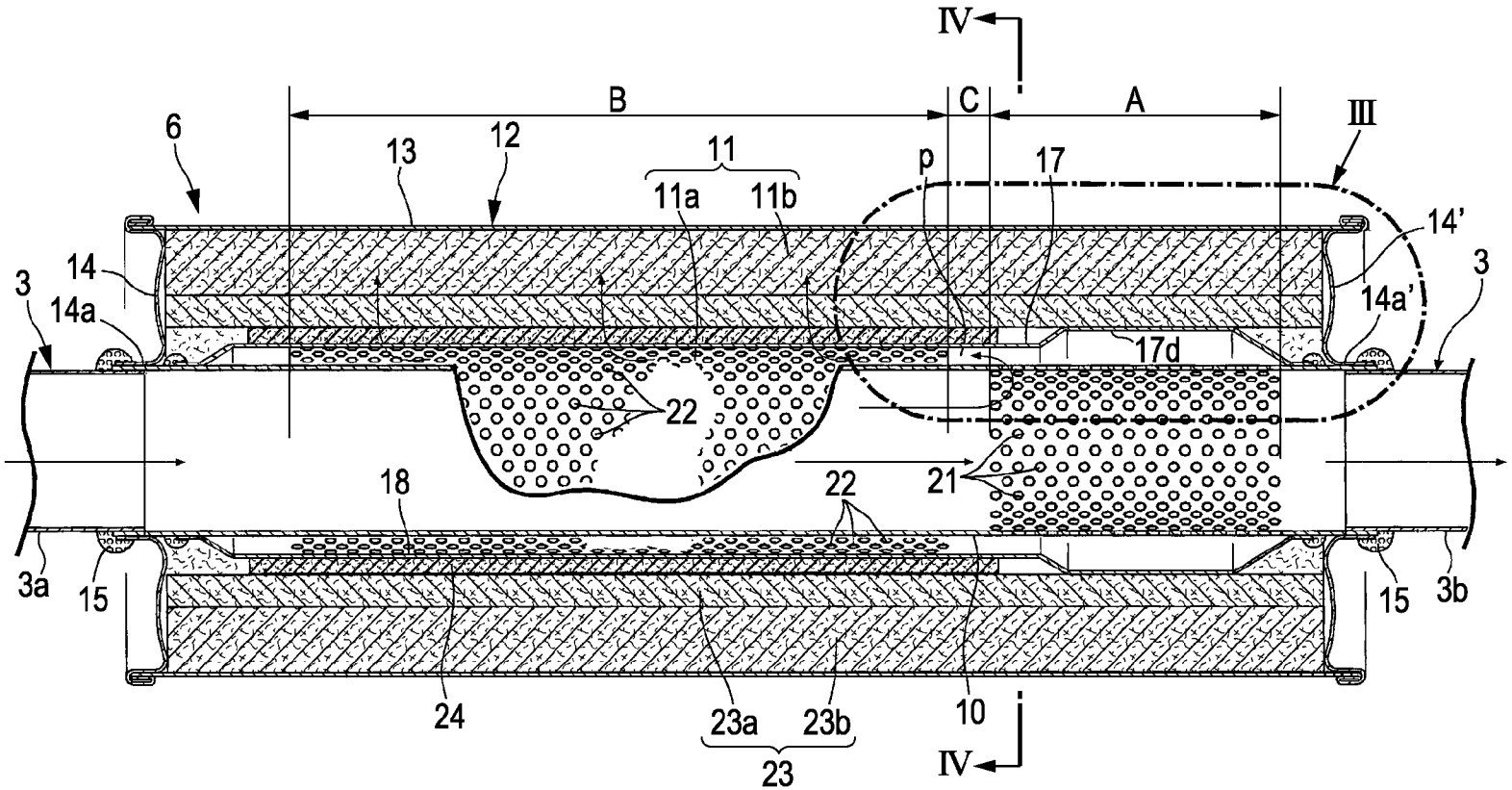
FIG. 2 is an enlarged sectional view of FIG. 1 taken along line II-II (first embodiment)
Figure 3:
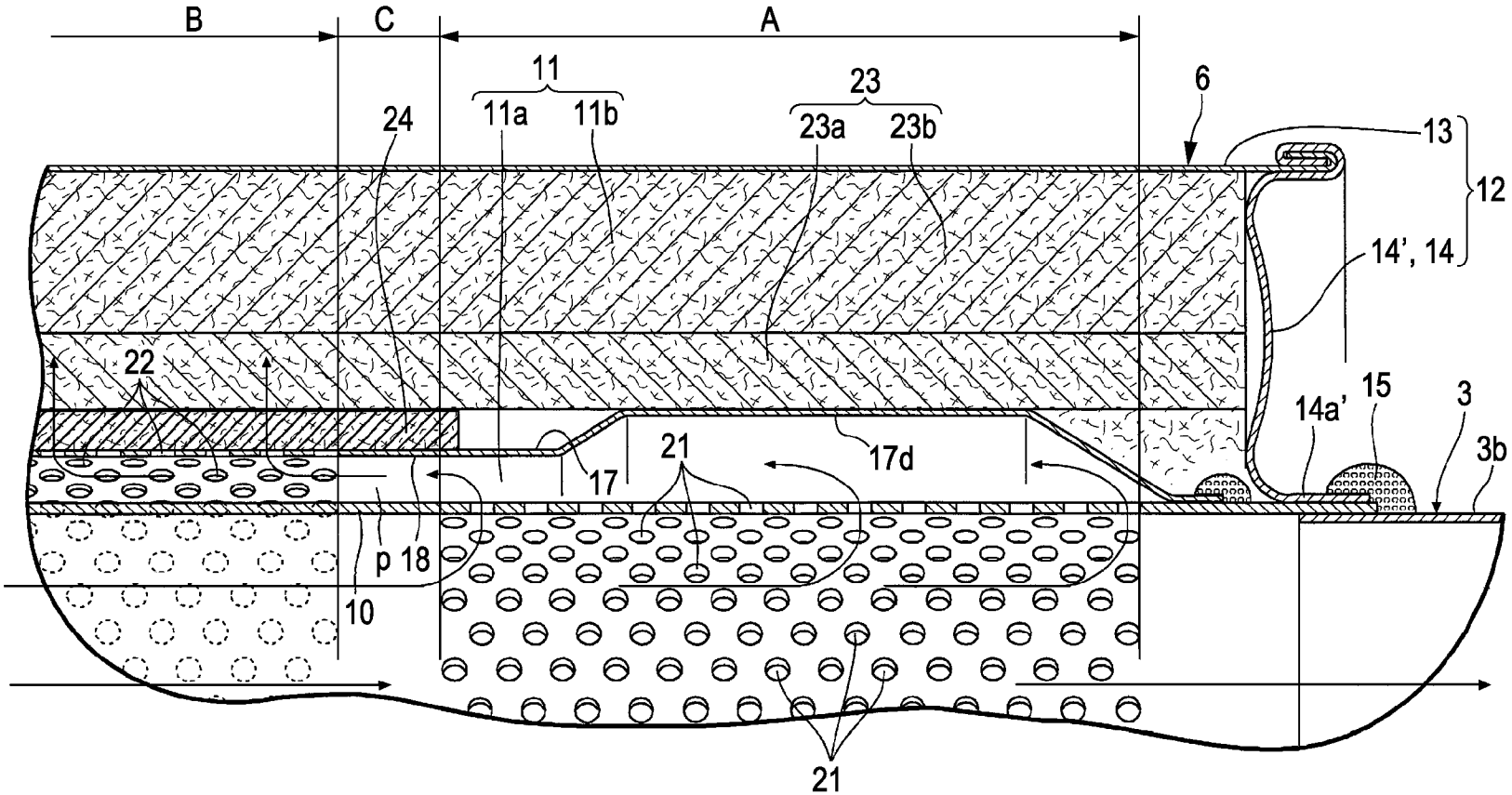
FIG. 3 is an enlarged view of a part III that is circled by an imaginary line in FIG. 2 (first embodiment)
Figure 4:
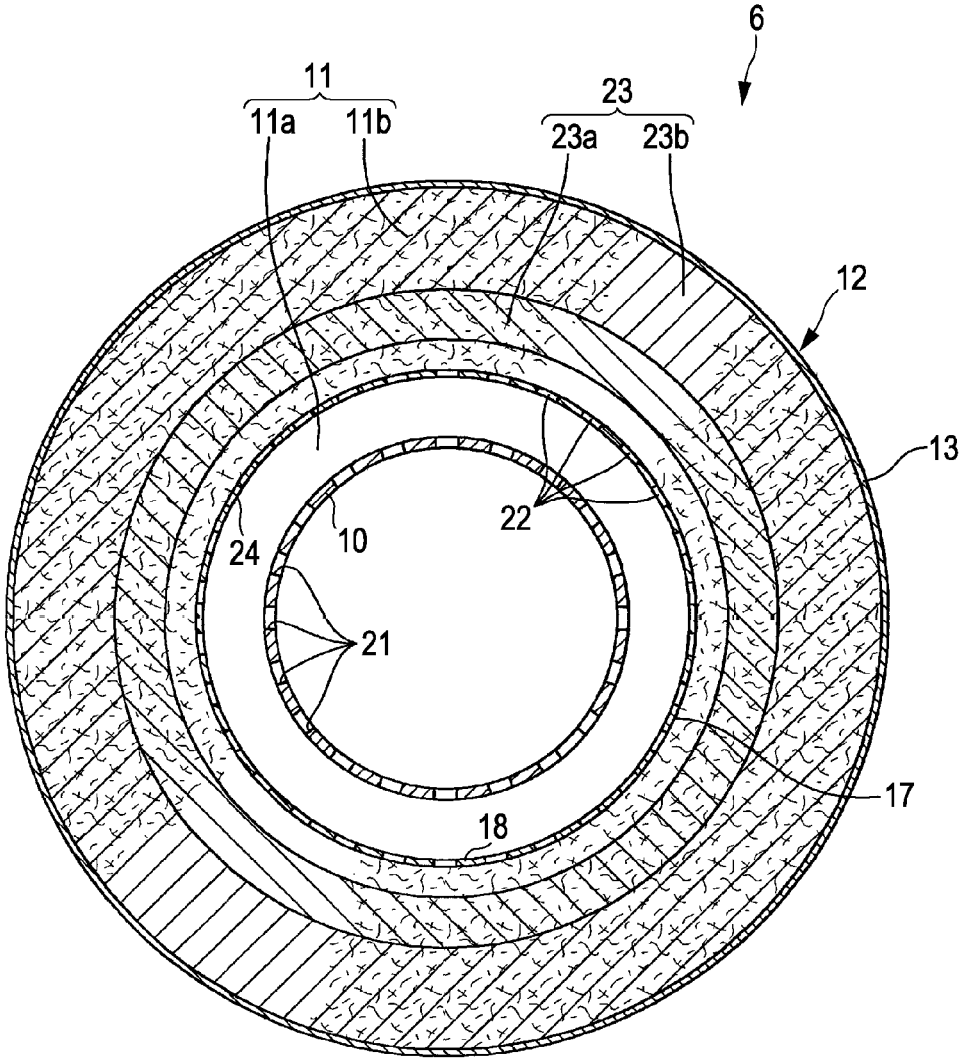
FIG. 4 is a sectional view of FIG. 2 taken along line IV-IV (first embodiment)

As illustrated in FIGS. 2 to 4, the pre-muffler 6 includes an inner cylinder 10 and a housing 12. The inner cylinder 10 is disposed at an intermediate position of the exhaust pipe 3 so as to divide the exhaust pipe 3 into an upstream exhaust pipe 3*a* positioned at the side closer to the exhaust manifold 1 and a downstream exhaust pipe 3*b* positioned at the side closer to the atmospheric opening 2. The housing 12 accommodates the inner cylinder 10 such as to define an expansion chamber 11 between the inner cylinder 10 and the housing 12. The housing 12 has a sealed structure formed by an outer cylinder 13 that substantially concentrically surrounds the inner cylinder 10 and a pair of annular end plates 14 and 14' that are bonded to the outer cylinder 13 at the open ends thereof by crimping. The end plates 14 and 14' respectively include bosses 14*a* and 14*a*' that are fitted to the outer peripheral surfaces of end portions of the inner cylinder 10. The bosses 14*a* and 14*a*' and the end portions of the inner cylinder 10 are airtightly bonded by annular welding 15 to the outer peripheral surfaces of end portions of the upstream and downstream exhaust pipes 3*a* and 3*b* that are opposed to each other. Thus, the upstream exhaust pipe 3*a* and the downstream exhaust pipe 3*b* communicate with each other through the inner cylinder 10.

The housing 12 also accommodates a partition cylinder 17 that sections the expansion chamber 11 into an inner expansion-chamber section 11*a* at an inner region in the radial direction and an outer expansion-chamber section 11*b* at an outer region in the radial direction. The partition cylinder 17 substantially concentrically surrounds the inner cylinder 10. End portions of the partition cylinder 17 are formed in a conical shape such that the diameter decreases toward the ends, and are bonded to the outer peripheral surface of the inner cylinder 10 by welding. A downstream portion 17*d* of the partition cylinder 17 that is close to the downstream exhaust pipe 3*b* has a larger diameter than the diameter of the remaining portion of the partition cylinder 17.

A group of inner-cylinder small holes 21 is formed in the inner cylinder 10 such that the inside of the inner cylinder 10 communicates with the inner expansion-chamber section 11*a*. As illustrated in FIG. 2, the inner-cylinder small holes 21 are formed over substantially the entire periphery of a downstream area A that is shorter than ½ of the entire length of the inner cylinder 10 (area corresponding to the downstream portion 17*d* of the partition cylinder 17).

In addition, a group of partition-cylinder small holes 22 is formed in a cylindrical portion 18 of the partition cylinder 17 such that the inner expansion-chamber section 11*a* and the outer expansion-chamber section 11*b* communicate with each other. The partition-cylinder small holes 22 are formed over substantially the entire periphery of an upstream area B that is longer than ½ of the entire length of the partition cylinder 17.

As illustrated in FIG. 2, the group of inner-cylinder small holes 21 and the group of partition-cylinder small holes 22 do not overlap each other in an axial direction. Accordingly, small holes are formed in neither the inner cylinder 10 nor the partition cylinder 17 in an area having a length corresponding to a predetermined distance C between the area A in which the inner-cylinder small holes 21 are formed and the area B in which the partition-cylinder small holes 22 are formed.

Each of the inner cylinder 10 having the inner-cylinder small holes 21 and the partition cylinder 17 having the partition-cylinder small holes 22 is formed by rounding a punching plate in which small holes are formed into a cylindrical shape and bonding the opposite edges of the punching plate together.

The outer expansion-chamber section 11*b* is filled with an acoustic material 23. The acoustic material 23 includes a first glass-wool layer 23*a* having a high heat resistance and a second glass-wool layer 23*b* that has a lower heat resistance than that of the first glass-wool layer 23*a* but is less expensive than the first glass-wool layer 23*a*. With this structure, the acoustic material 23 not only provides sound absorbency but also satisfies the requirements for heat resistance and cost efficiency. To prevent the acoustic material 23 from being pulled into the inner expansion-chamber section 11*a* through the partition-cylinder small holes 22, a filter 24 formed of, for example, stainless steel wool and having a high heat resistance is provided along the outer peripheral surface of the partition cylinder 17.

The process of assembling the pre-muffler 6 having the above-described structure will now be described.

The partition cylinder 17 is fitted to the outer peripheral surface of the inner cylinder 10, and the inner cylinder 10 and the partition cylinder 17 are integrated with each other at the ends thereof by welding. Then, the filter 24, the first glass-wool layer 23*a*, and the second glass-wool layer 23*b* are successively wound around the integrated body of the inner cylinder 10 and the partition cylinder 17, and are inserted into the outer cylinder 13 together with the integrated body. Then, the end plates 14 and 14' are attached to the outer cylinder 13 at the ends thereof, and are bonded to the outer cylinder 13 at the ends thereof by crimping. Then, the upstream and downstream exhaust pipes 3*a* and 3*b* are inserted into the respective end portions of the inner cylinder 10. The end plate 14, one end portion of the inner cylinder 10, and the upstream exhaust pipe 3*a* are welded together, and the end plate 14', the other end portion of the inner cylinder 10, and the downstream exhaust pipe 3*b* are welded together.

The operation of the first embodiment will now be described.

During the operation of the engine E, the exhaust gas discharged from the engine E is guided through the exhaust manifold 1 to the exhaust pipe 3. Harmful components, such as HC, CO, and $NO_X$, contained in the exhaust gas are removed by the catalytic converter 5. Then, the exhaust gas is guided successively through the pre-muffler 6 and the main muffler 7, which serve to deaden the sound, and is then discharged to the atmosphere.

The process of deadening the sound of the exhaust gas guided into the pre-muffler 6 having the above-described structure will now be described.

The exhaust gas that flows through the upstream exhaust pipe 3*a* is guided into the inner cylinder 10 in the housing 12. A part of the exhaust gas that flows through the inner cylinder 10 flows into the inner expansion-chamber section 11*a* through the inner-cylinder small holes 21, and then flows into the outer expansion-chamber section 11*b* through the partition-cylinder small holes 22. The sound of the exhaust gas is deadened by the acoustic material 23 in the outer expansion-chamber section 11*b*.

The group of inner-cylinder small holes 21 and the group of partition-cylinder small holes 22 do not overlap each other in the axial direction, and are separated from each other by the predetermined distance C in the axial direction. Therefore, an annular exhaust passage p which has no small holes and which extends over the distance C is defined by the outer periphery of the inner cylinder 10 and the inner periphery of the partition cylinder 17 at a position between an exhaust passage in the inner cylinder 10 and the inner expansion-chamber section 11*a*. Owing to the exhaust passage p, the length of an exhaust passage from one end of the inner cylinder 10 to the inner expansion-chamber section 11*a* is increased by the length corresponding to the distance C, and the length of an exhaust passage from the other end of the inner cylinder 10 to the inner expansion-chamber section 11*a* is also increased by the length corresponding to the distance C. As a result, the length of an exhaust passage from the exhaust collecting section 1*a* of the exhaust manifold 1 to the inner expansion-chamber section 11*a* is increased by the length corresponding to the distance C, and the length of an exhaust passage from the inner expansion-chamber section 11*a* to the atmospheric opening 2 of the tail pipe is also increased by the length corresponding to the distance C. Thus, the substantial length of the entire exhaust passage is increased. Therefore, the sound-pressure attenuation effect for the low-frequency component of the sound of the exhaust gas that flows through the pre-muffler 6 can be increased.

As described above, the attenuation effect can be increased simply by changing the relative position between the group of inner-cylinder small holes 21 and the group of partition-cylinder small holes 22 in the axial direction. Therefore, the attenuation effect can be increased without being affected by the restriction on the total vehicle length or the need to avoid interference with other components under the vehicle floor, which often make it difficult to increase the length of the exhaust pipe.

Next, a modification of the first embodiment will be described with reference to FIG. 5.

In this modification, components similar to those of the first embodiment are denoted by the same reference numerals.

Figure 5:
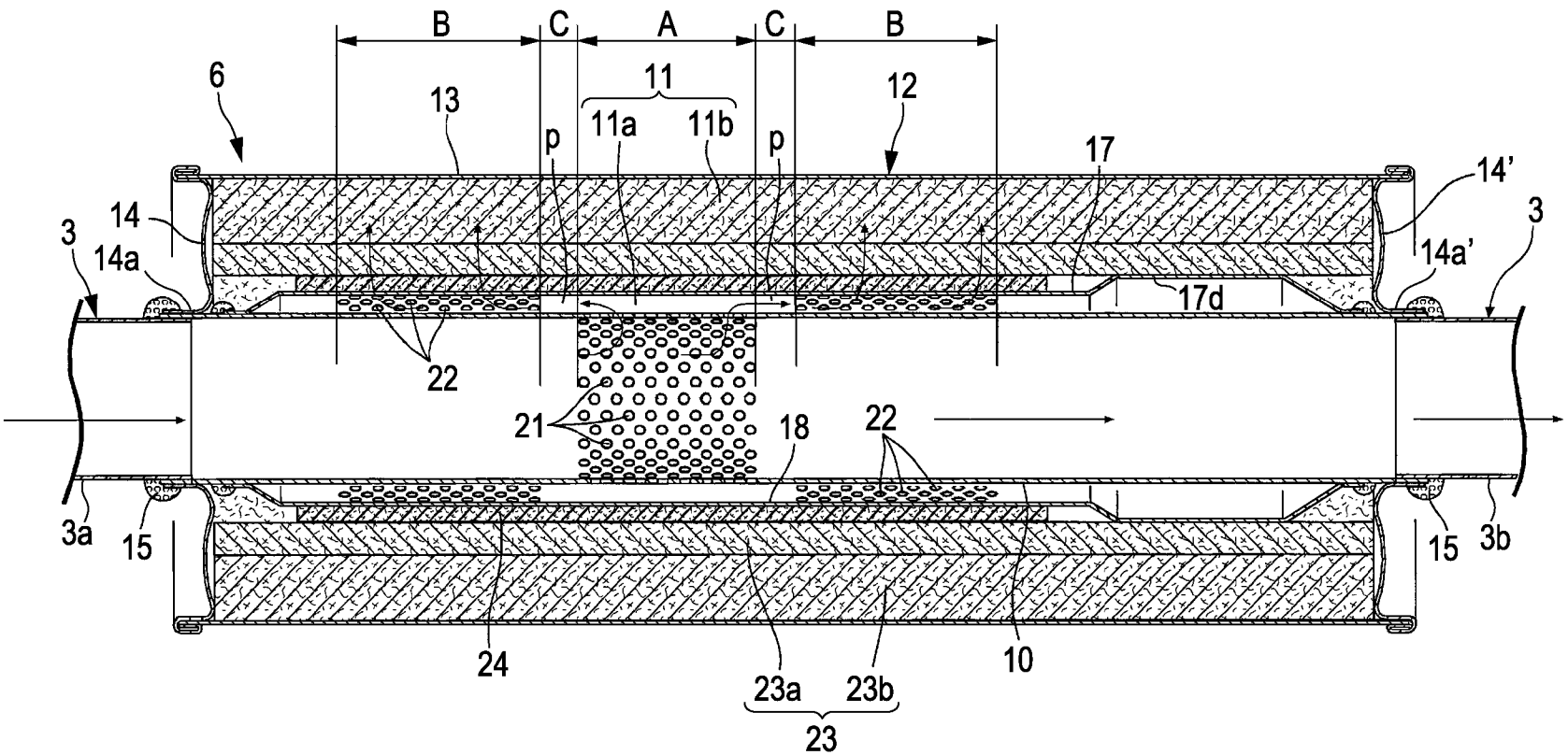
FIG. 5 is a sectional view corresponding to the sectional view shown in FIG. 2 (modification of first embodiment)

Referring to FIG. 5, a group of inner-cylinder small holes 21 is formed in an intermediate section of the inner cylinder 10 in the axial direction. The inner-cylinder small holes 21 are formed over substantially the entire periphery of an intermediate area A in the axial direction. In addition, groups of partition-cylinder small holes 22 are formed in the partition cylinder 17. The partition-cylinder small holes 22 are formed over substantially the entire periphery of areas B and B that are on both sides of the group of inner-cylinder small holes 21 in the axial direction and that are separated from the group of partition-cylinder small holes 22 by distances C and C (by areas having no small holes). Other structures are similar to those of the first embodiment.

The operation of this modification is similar to that of the first embodiment. More specifically, the group of inner-cylinder small holes 21 and the groups of partition-cylinder small holes 22 do not overlap each other in the axial direction, and are separated from each other by the predetermined distances C and C in the axial direction. Therefore, annular exhaust passages p and p which have no small holes and which extend over the distances C and C are defined by the outer periphery of the inner cylinder 10 and the inner periphery of the partition cylinder 17 at positions between an exhaust passage in the inner cylinder 10 and the inner expansion-chamber section 11*a*. Owing to the exhaust passages p and p, the length of an exhaust passage from one end of the inner cylinder 10 to the inner expansion-chamber section 11*a* is increased by the lengths corresponding to the distances C and C, and the length of an exhaust passage from the other end of the inner cylinder 10 to the inner expansion-chamber section 11*a* is also increased by the lengths corresponding to the distances C and C. Thus, the substantial length of the entire exhaust passage is increased. Therefore, similar to the structure of the first embodiment, the sound-pressure attenuation effect for the low-frequency component of the sound of the exhaust gas that flows through the pre-muffler 6 can be increased.

Figure 6:
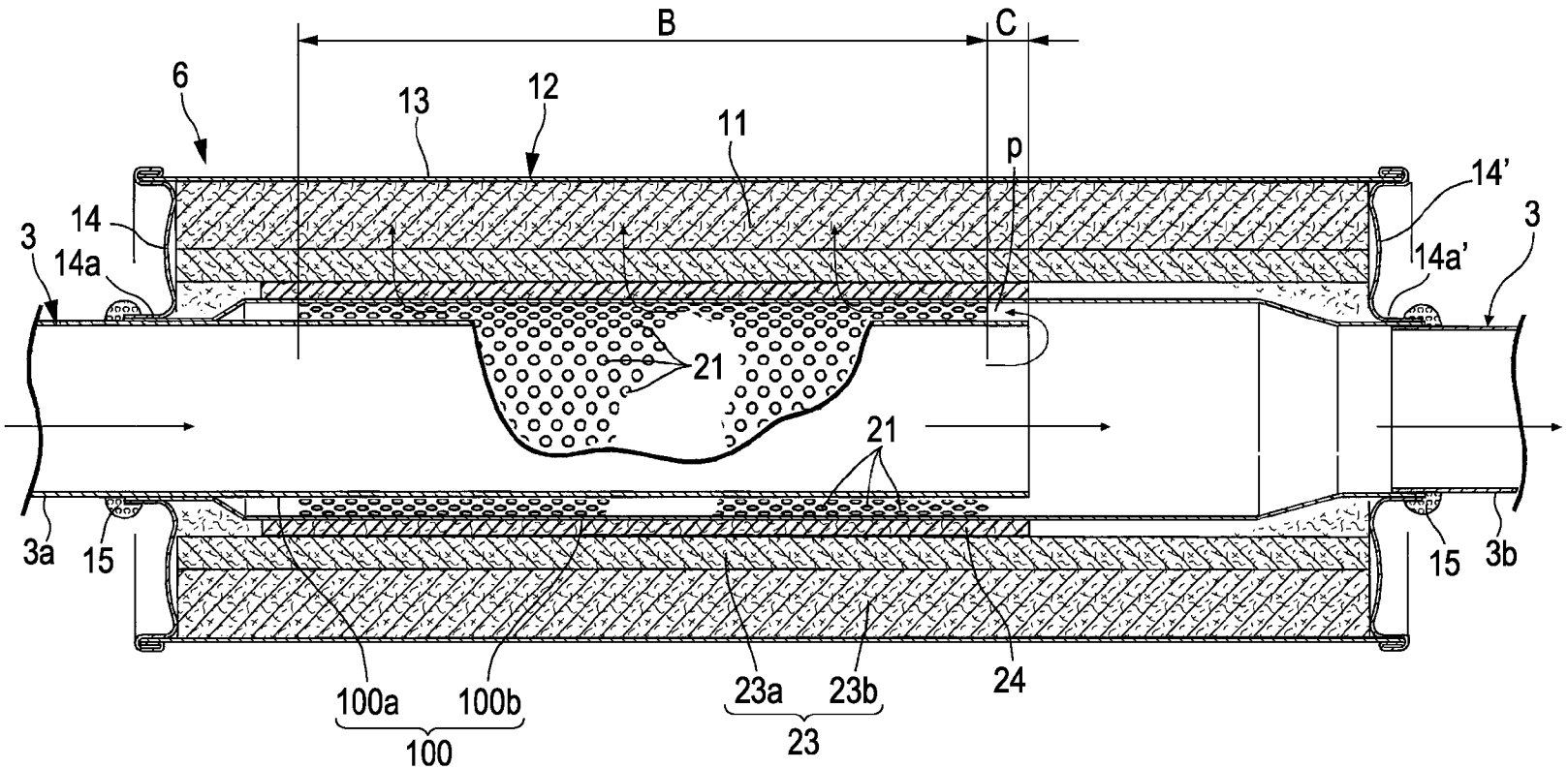
FIG. 6 is a sectional view corresponding to the sectional view shown in FIG. 2 (second embodiment)

Next, a second embodiment of the present invention will be described with reference to FIG. 6.

In the second embodiment, components similar to those of the first embodiment are denoted by the same reference numerals.

In the second embodiment, an inner cylinder 100, which is connected to the exhaust pipe 3, has a double-cylinder structure including an inner-side cylinder 100*a* and an outer-side cylinder 100*b*, and the partition cylinder 17 described in the first embodiment is omitted.

The pre-muffler 6 includes the inner cylinder 100 and the housing 12 that accommodates the inner cylinder 100 such as to define the expansion chamber 11 between the inner cylinder 100 and the housing 12. The inner cylinder 100 includes the inner-side cylinder 100*a* which extends continuously from the upstream exhaust pipe 3*a* and the outer-side cylinder 100*b* through which the inner-side cylinder 100*a* communicates with the downstream exhaust pipe 3*b*.

The outer-side cylinder 100*b* extends from a first end (upstream end) to a second end (downstream end) of the housing 12 in the axial direction. The inner-side cylinder 100*a* is fitted to and supported in a cantilever manner by the inner periphery of the outer-side cylinder 100*b* at the first end of the housing 12. The inner-side cylinder 100*a* extends toward the second end of the housing 12 such that a space is provided between the inner-side cylinder 100*a* and the outer-side cylinder 100*b*. An open end of the inner-side cylinder 100*a* at the downstream end thereof is positioned in front of (upstream of) the second end of the housing 12. A group of inner-cylinder small holes 21 is formed in the outer-side cylinder 100*b* such that the inside of the outer-side cylinder 100*b* communicates with the expansion chamber 11. The inner-cylinder small holes 21 are formed over substantially the entire periphery of an area B that extends toward the first end (upstream end) from a position that is closer to the first end (upstream end) than the open end of the inner-side cylinder 100*a* by a predetermined distance C.

The housing 12 has a sealed structure formed by an outer cylinder 13 that substantially concentrically surrounds the inner cylinder 100 and a pair of annular end plates 14 and 14' that are bonded to the outer cylinder 13 at the open ends thereof by crimping. The end plates 14 and 14' respectively include bosses 14*a* and 14*a*' that are fitted to the outer peripheral surfaces of end portions of the outer-side cylinder 100*b*. The boss 14*a* is fitted to the outer peripheral surface of the outer-side cylinder 100*b* and is airtightly bonded to the outer-side cylinder 100*b* together with the upstream exhaust pipe 3*a* by welding. The boss 14*a*' is fitted to the outer peripheral surface of the outer-side cylinder 100*b* and is airtightly bonded to the outer-side cylinder 100*b* together with the downstream exhaust pipe 3*b* by welding.

The expansion chamber 11 is filled with an acoustic material 23. Similar to the first embodiment, the acoustic material 23 includes a first glass-wool layer 23*a* and a second glass-wool layer 23*b*.

To prevent the acoustic material 23 from being pulled into the inner cylinder 100 through the inner-cylinder small holes 21, a filter 24 formed of, for example, stainless steel wool is provided along the outer peripheral surface of the outer-side cylinder 100*b*.

The process of assembling the pre-muffler 6 having the above-described structure will now be described.

The filter 24, the first glass-wool layer 23*a*, and the second glass-wool layer 23*b* are successively wound around the outer-side cylinder 100*b*, and are inserted into the outer cylinder 13 together with the outer-side cylinder 100*b*. Then, the end plates 14 and 14' are attached to the outer cylinder 13 at the ends thereof, and are bonded to the outer cylinder 13 at the ends thereof by crimping. Then, the inner-side cylinder 100*a*, which extends continuously from the upstream exhaust pipe 3*a*, and the downstream exhaust pipe 3*b* are inserted into the outer-side cylinder 100*b* from the respective ends. The end plate 14, the outer-side cylinder 100*b*, and the upstream exhaust pipe 3*a* are welded together and the end plate 14', the outer-side cylinder 100*b*, and the downstream exhaust pipe 3*b* are welded together.

The process of deadening the sound of the exhaust gas guided into the pre-muffler 6 having the above-described structure will now be described.

A part of the exhaust gas that flows into the inner-side cylinder 100*a* that continues from the upstream exhaust pipe 3*a* flows into the expansion chamber 11 through the inner-cylinder small holes 21, and the sound is deadened by the acoustic material 23 in the expansion chamber 11.

The inner cylinder 100 has the double-cylinder structure including the inner-side cylinder 100*a* and the outer-side cylinder 100*b*, and the inner-cylinder small holes 21 are formed in the outer-side cylinder 100*b* in the area B that extends toward the first end (upstream end) from a position that is closer to the first end (upstream end) than the open end of the inner-side cylinder 100*a* by a predetermined distance C. Therefore, when a space defined between the outer-side cylinder 100*b* and the inner-side cylinder 100*a* of the inner cylinder 100 is considered, a part of the space in the area B that extends toward the first end from the position that is closer to the first end than the open end of the inner-side cylinder 100*a* by the predetermined distance C functions as an expansion chamber that is integrated with the expansion chamber 11 formed between the inner cylinder 100 and the housing 12. In addition, a portion p that extends by the predetermined distance C from the area B to the open end of the inner-side cylinder 100*a* serves as an annular exhaust passage that is connected to the expansion chamber 11. Owing to this annular exhaust passage p, the length of an exhaust passage from one end of the inner cylinder 100 to the expansion chamber 11 is increased by the length corresponding to the distance C, and the length of an exhaust passage from the other end of the inner cylinder 100 to the expansion chamber 11 is also increased by the length corresponding to the distance C. As a result, the length of an exhaust passage from the exhaust collecting section 1*a* of the exhaust manifold 1 to the expansion chamber 11 of the silencer is increased by the length corresponding to the distance C, and the length of an exhaust passage from the expansion chamber 11 to the atmospheric opening 2 of the tail pipe is also increased by the length corresponding to the distance C. Thus, the length of the entire exhaust passage is increased. Therefore, the sound-pressure attenuation effect for the low-frequency component of the sound of the exhaust gas can be increased.

As described above, the attenuation effect can be increased simply by forming the inner cylinder 100 in the double-cylinder structure including the inner-side cylinder 100*a* and the outer-side cylinder 100*b* and forming the group of small holes 21 in the outer-side cylinder 100*b* in the area that extends toward the first end from the position that is closer to the first end than the open end of the inner-side cylinder 100*a* by the predetermined distance C. Therefore, the above-described structure is not affected by the restriction on the total vehicle length or the need to avoid interference with other components under the vehicle floor, which often make it difficult to increase the exhaust passage.

Figure 7:
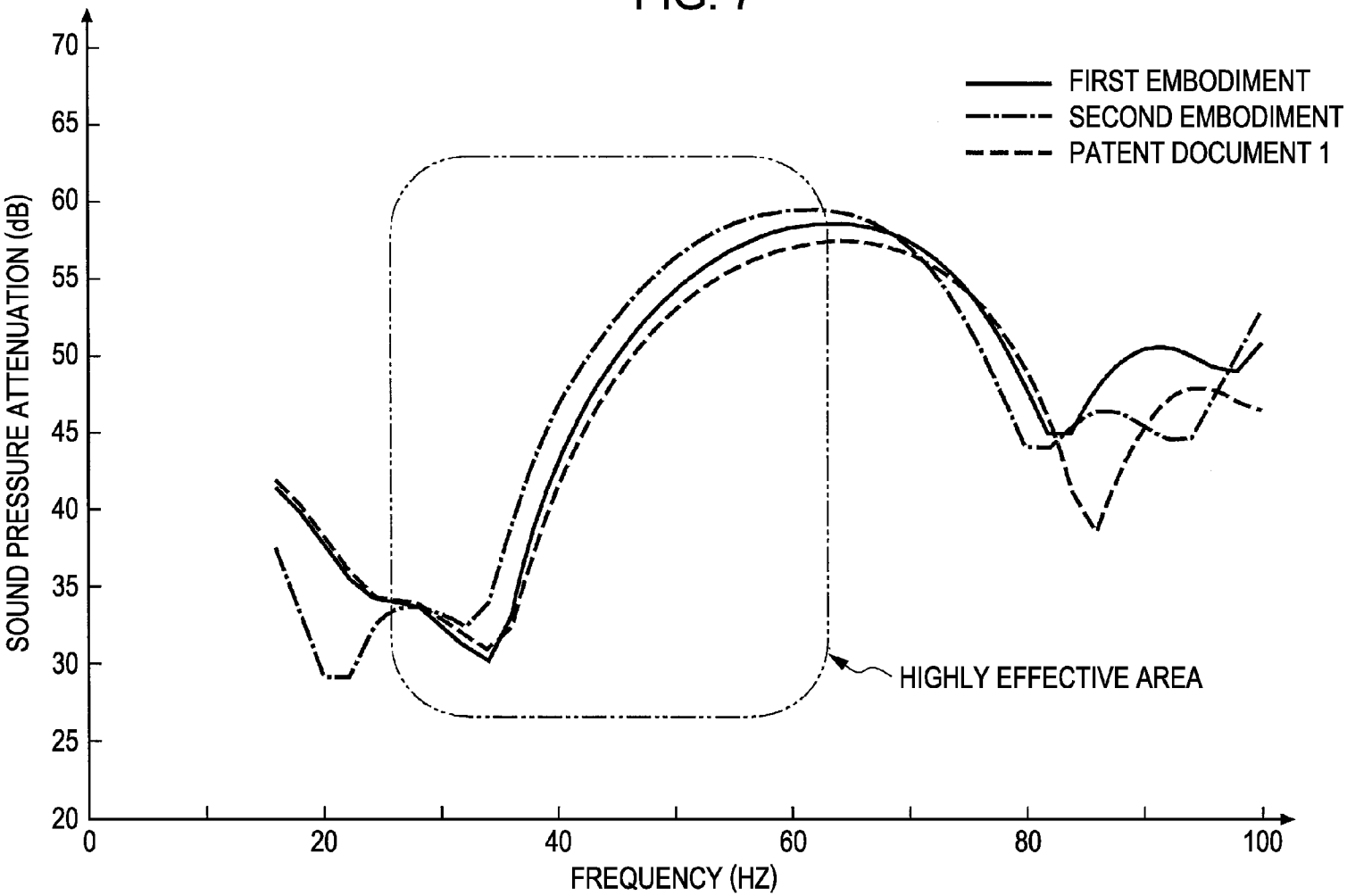
FIG. 7 is a graph illustrating the variation in sound-pressure attenuation with respect to frequency.

FIG. 7 is a graph illustrating the result of an experiment for comparing the first and second embodiments of the present invention and the structure disclosed in Japanese Unexamined Patent Application Publication No. 2008-138608. In this experiment, sound with a predetermined frequency was input from a speaker to an inlet (upstream end) of each silencer and attenuation of the sound input from the inlet was measured at an outlet (downstream end) of the silencer. The measurement was performed while the frequency of the sound input to the inlet was set to various frequencies. In FIG. 7, the vertical axis of the graph shows the sound-pressure attenuation (dB), and the horizontal axis of the graph shows the frequency (Hz). The solid line and the one-dot chain line show the results obtained by the silencers according to the first embodiment and the second embodiment, respectively. The dashed line shows the result obtained by the silencer having the structure disclosed in Japanese Unexamined Patent Application Publication No. 2008-138608. As is clear from the result of the experiment, according to the silencers of the first and second embodiments, the attenuation was increased in the area surrounded by the two-dot chain line in a low-frequency range (smaller than or equal to 100 Hz).

Although the embodiments of the present invention are described above, the present invention is not limited to the above-described embodiments and various other embodiments can be provided within the scope of the present invention.

For example, the effect according to Japanese Unexamined Patent Application Publication No. 2008-138608, that is, the effect that silencing effect similar to that obtained when a silencer is placed at an antinode of a standing wave can be obtained, is achieved by positioning the group of small holes in the inner cylinder at a position biased to one side in the axial direction (first embodiment) or by positioning the open end of the inner-side cylinder at a position biased to one side in the axial direction (second embodiment). However, the embodiments of the present invention are irrelevant from the above-described effect, and can be carried out even when the group of small holes in the inner cylinder or the open end of the inner-side cylinder is positioned at a central position in the axial direction. In other words, the embodiments of the present invention can be carried out irrespective of the position of the group of small holes in the inner cylinder or the position of the open end of the inner-side cylinder. However, if the length of the area in which the small holes are formed in the partition cylinder (first embodiment) or the length of the area in which the small holes are formed in the outer-side cylinder (second embodiment) in the axial direction is excessively small, the exhaust sound cannot be sufficiently spread into the acoustic material and the sound-pressure attenuation effect for the high-frequency component will be reduced. Therefore, in practice, the group of small holes in the inner cylinder or the open end of the inner-side cylinder is positioned within an area where such a negative effect can be avoided. However, when attention is focused on the effect of the embodiments of the present invention that the sound-pressure attenuation effect for the low-frequency component of exhaust sound can be increased by increasing the length of the exhaust passage, the embodiments of the present invention can be carried out irrespective of the position of the group of small holes in the inner cylinder or the position of the open end of the inner-side cylinder in the axial direction.

According to an embodiment of the present invention, the group of inner-cylinder small holes in the inner cylinder and the group of partition-cylinder small holes in the partition cylinder do not overlap each other in the axial direction, and are separated from each other by a predetermined distance in the axial direction. Therefore, an annular exhaust passage which has no small holes and which extends over the predetermined distance is defined by the outer periphery of the inner cylinder and the inner periphery of the partition cylinder at a position between an exhaust passage in the inner cylinder and the expansion chamber. As a result, the length of an exhaust passage from the exhaust collecting section of the exhaust manifold to the expansion chamber in the silencer is increased by the length corresponding to the predetermined distance, and the length of an exhaust passage from the expansion chamber to the open end of the tail pipe is also increased by the length corresponding to the predetermined distance. Thus, the length of the entire exhaust passage is increased compared to that in the structure disclosed in Japanese Unexamined Patent Application Publication No. 2008-138608. Therefore, the sound-pressure attenuation effect for the low-frequency component of the exhaust sound can be increased without increasing the length of the exhaust pipe or the capacity of the silencer.

In addition, the attenuation effect can be increased simply by changing the relative position between the group of inner-cylinder small holes and the group of partition-cylinder small holes in the axial direction. Therefore, the attenuation effect can be increased without being affected by the restriction on the total vehicle length or the need to avoid interference with other components under the vehicle floor, which often make it difficult to increase the length of the exhaust pipe.

According to another embodiment of the present invention, the inner cylinder has a double-cylinder structure including the inner-side cylinder and the outer-side cylinder, and the group of inner-cylinder small holes is formed in the outer-side cylinder in the area that extends toward the first end from the position closer to the first end than the open end of the inner-side cylinder by the predetermined distance. Therefore, the length of an exhaust passage from one end of the inner cylinder to the expansion chamber is increased compared to that in the silencer disclosed in Japanese Unexamined Patent Application Publication No. 2008-138608 by the length corresponding to the predetermined distance. In addition, the length of an exhaust passage from the other end of the inner cylinder to the expansion chamber is also increased compared to that in the silencer disclosed in Japanese Unexamined Patent Application Publication No. 2008-138608 by the length corresponding to the predetermined distance. As a result, the length of an exhaust passage from the exhaust collecting section of the exhaust manifold to the expansion chamber in the silencer is increased by the length corresponding to the predetermined distance, and the length of an exhaust passage from the expansion chamber to the open end of the tail pipe is also increased by the length corresponding to the predetermined distance. Thus, the length of the entire exhaust passage is increased compared to that in the structure disclosed in Japanese Unexamined Patent Application Publication No. 2008-138608. Therefore, the sound-pressure attenuation effect for the low-frequency component of the exhaust sound can be increased without increasing the length of the exhaust pipe or the capacity of the silencer.

In addition, the attenuation effect can be increased simply by forming the inner cylinder in the double-cylinder structure including the inner-side cylinder and the outer-side cylinder and forming the group of small holes in the outer-side cylinder in the area that extends toward the first end from the position that is closer to the first end than the open end of the inner-side cylinder by the predetermined distance. Therefore, the above-described structure is not affected by the restriction on the total vehicle length or the need to avoid interference with other components under the vehicle floor, which often make it difficult to increase the exhaust passage.

Obviously, numerous modifications and variations of the present invention are possible in light of the above teachings. It is therefore to be understood that within the scope of the appended claims, the invention may be practiced otherwise than as specifically described herein.

What is claimed is:

1. A silencer provided on an exhaust pipe of a vehicle engine, the silencer comprising:

an inner cylinder disposed at an intermediate position of the exhaust pipe;

a housing that accommodates the inner cylinder and defines an expansion chamber between the inner cylinder and the housing; and a partition cylinder accommodated in the housing and sectioning the expansion chamber into an inner expansion-chamber section at an inner region in a radial direction and an outer expansion-chamber section at an outer region in the radial direction, the outer expansion-chamber section being filled with an acoustic material, the partition cylinder having a group of partition-cylinder small holes through which the inner expansion-chamber section and the outer expansion-chamber section communicate with each other, wherein the inner cylinder has a group of inner-cylinder small holes through which an inside of the inner cylinder communicates with the inner expansion-chamber section, wherein the group of partition-cylinder small holes and the group of inner-cylinder small holes do not overlap each other in an axial direction and are separated from each other by a predetermined distance in the axial direction, and wherein the partition cylinder includes a downstream portion that is adjacent to an outlet of said silencer and has a diameter that is larger than a diameter of a remaining portion of the partition cylinder.

2. The silencer according to claim 1, wherein the group of inner-cylinder small holes are formed over substantially an entire periphery of a downstream area of the inner cylinder that is less than half of an entire length of the inner cylinder.

3. The silencer according to claim 2, wherein the downstream area of inner cylinder upon which the group of inner-cylinder small holes is formed overlaps with the downstream portion of the partition cylinder.

4. The silencer according to claim 1, wherein the group of partition-cylinder small holes are formed over substantially an entire periphery of an upstream area of the partition cylinder that is longer than half of an entire length of the partition cylinder.

5. The silencer according to claim 1, wherein the group of partition-cylinder small holes are formed over substantially an entire periphery of an upstream area of the partition cylinder and are formed over substantially an entire periphery of a downstream area of the partition cylinder, and wherein the group of inner-cylinder small holes are formed over substantially an entire periphery of an intermediate area of the inner cylinder that is located between the upstream area and the downstream area in the axial direction.

6. The silencer according to claim 5, wherein no holes are formed in the inner cylinder and in the partition cylinder for the predetermined distance in the axial direction between the upstream area and the intermediate area, and wherein no holes are formed in the inner cylinder and in the partition cylinder for the predetermined distance in the axial direction between the downstream area and the intermediate area.

7. The silencer according to claim 5, wherein the group of partition-cylinder small holes and the group of inner-cylinder small holes are all formed at locations upstream of the downstream portion of the partition cylinder in the axial direction.

* * * * *